US005904434A

United States Patent [19]

Bekius et al.

[11] Patent Number: 5,904,434

[45] Date of Patent: May 18, 1999

[54] INTERNAL FEED PAINTBRUSH

[75] Inventors: Wayne M. Bekius, Milaca; Steven A. Anderson; Mark E. Snetting, both of Eden Prairie; Steven R. Arvidson, Andover, all of Minn.; Douglas K. Rose, Vermillion, S. Dak.

[73] Assignee: Wagner Spray Tech Corporation, Minneapolis, Minn.

[21] Appl. No.: 08/907,555

[22] Filed: Aug. 8, 1997

[51] Int. Cl.[6] ..... A46B 11/04

[52] U.S. Cl. ..... 401/288; 401/286; 401/282

[58] Field of Search ..... 401/288, 286, 401/282, 289, 287

[56] References Cited

U.S. PATENT DOCUMENTS

| | | | |
|---|---|---|---|
| 141,522 | 8/1873 | Thompson . | |
| D. 292,649 | 11/1987 | Engelman | D4/114 |
| 703,385 | 7/1902 | Carryl . | |
| 734,319 | 7/1903 | Grahn . | |
| 753,125 | 2/1904 | Cooper . | |
| 991,709 | 5/1911 | Fischer . | |
| 1,038,376 | 9/1912 | Jaeschke . | |
| 1,067,780 | 7/1913 | Brink . | |
| 1,253,934 | 1/1918 | Busch . | |
| 1,668,931 | 5/1928 | Zimmer . | |
| 1,862,430 | 6/1932 | Robb . | |
| 2,537,377 | 1/1951 | Soss | 299/89 |
| 2,817,869 | 12/1957 | Hughes | 15/248 |
| 2,960,040 | 11/1960 | Bischoff | 103/148 |
| 3,310,831 | 3/1967 | Brinker | 15/575 |
| 3,337,899 | 8/1967 | Rentfrow | 15/510 |
| 3,418,054 | 12/1968 | Kirch | 401/188 |
| 3,462,231 | 8/1969 | Pomares | 401/176 |
| 3,503,691 | 3/1970 | Kirch | 401/188 |
| 3,539,268 | 11/1970 | Stebbins | 401/197 |
| 3,554,659 | 1/1971 | Stokes | 401/197 |
| 3,640,630 | 2/1972 | Walker | 401/188 |
| 3,658,432 | 4/1972 | Lanusse | 401/219 |
| 3,786,966 | 1/1974 | Behunin et al. | 222/387 |
| 3,906,573 | 9/1975 | Crawford | 15/22 R |
| 4,250,586 | 2/1981 | Timian | 15/22 R |
| 4,676,685 | 6/1987 | Murphy | 401/285 |
| 4,695,176 | 9/1987 | Simonnette et al. | 401/144 |
| 4,732,503 | 3/1988 | Bader et al. | 401/197 |
| 4,871,275 | 10/1989 | Aldous | 401/23 |
| 5,054,947 | 10/1991 | Frank et al. | 401/146 |
| 5,071,278 | 12/1991 | Chen | 401/146 |
| 5,139,357 | 8/1992 | Reents | 401/146 |
| 5,246,302 | 9/1993 | Wey | 401/153 |

*Primary Examiner*—David J. Walczak
*Attorney, Agent, or Firm*—Faegre & Benson LLP

[57] ABSTRACT

An improved internal feed paint brush having a flexible liquid-impermeable paint distribution manifold interior of a plurality of filaments formed of a flat, woven nylon cloth conduit coated with polyurethane film and sealed to a rigid plastic end cap and having a plurality of channels in the distribution manifold formed by a plurality of spaced-apart, longitudinally extending bonds in the coated nylon material. The manifold is sonically welded to the end cap and the filament and manifold assembly is sealed with epoxy.

13 Claims, 7 Drawing Sheets

INTERNAL FEED PAINTBRUSH

BACKGROUND OF THE INVENTION

This invention relates to the field of painting, more particularly, to a paint brush having an internally fed paint distribution system.

DETAILED DESCRIPTION OF THE INVENTION

Figure 1:
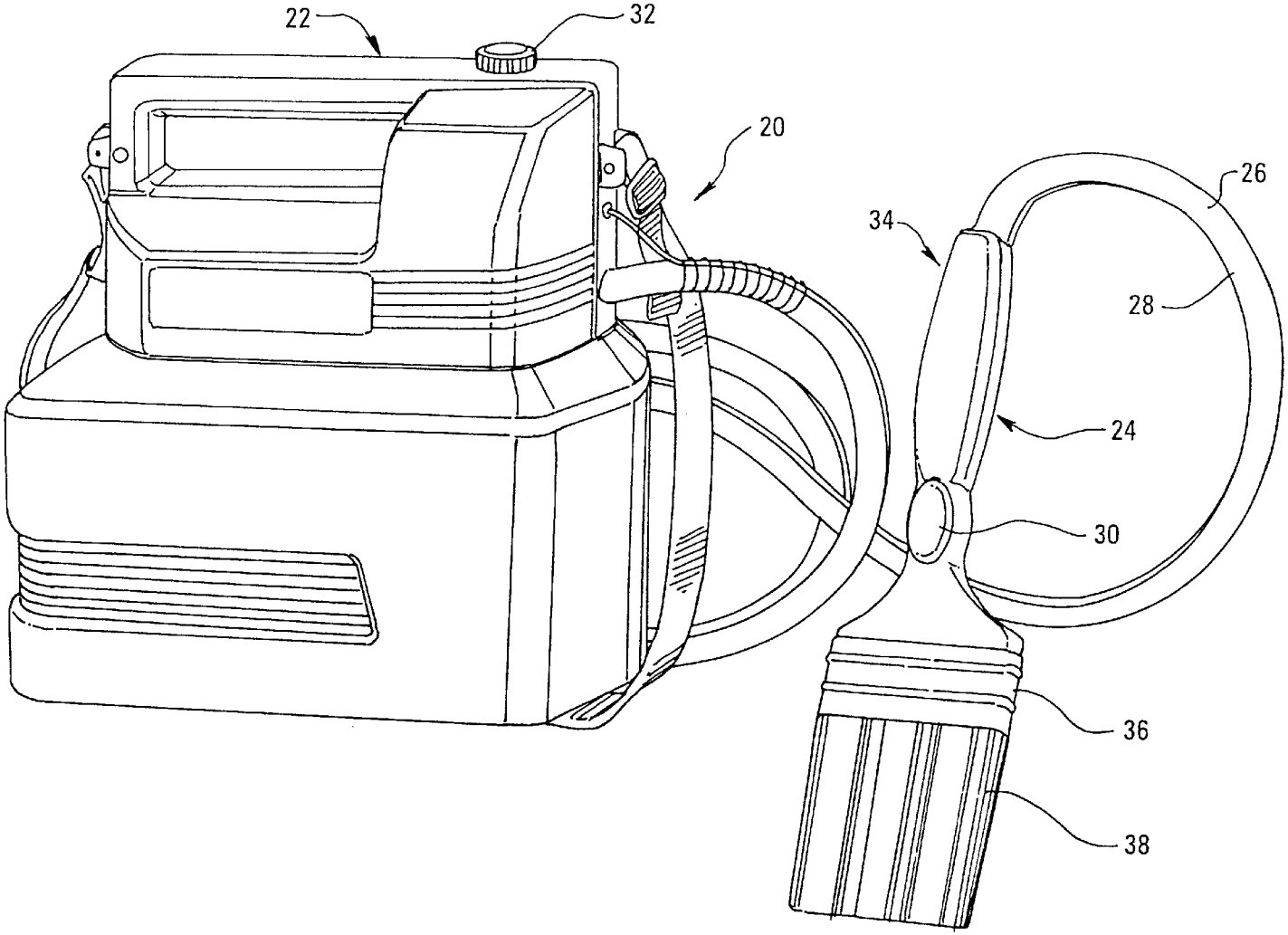
FIG. 1 is a perspective view of an internally fed brush and portable paint supply container useful in the practice of the present invention.

Referring now to the Figures, and most particularly to FIG. 1, a portable painting system 20 may be seen. System 20 includes a portable pump and paint reservoir 22 connected to an internally fed paint brush 24 via a pair of flexible tubes 26, 28. Tube 26 delivers paint from reservoir 22 to brush 24 when the pump (not shown) is actuated by an air button 30 which sends a signal via tube 28 to the pump to deliver paint when the air button 30 is depressed. In one embodiment, air button 30 actuates a latching switch (not shown) in pump and reservoir unit 22 such that the pump is turned ON upon one actuation and OFF at the next actuation. In an alternative embodiment, air button 30 can control a momentary contact electrical switch to control the pump such that the pump is ON only while the air button 30 is depressed. In the embodiment shown, a variable speed control knob 32 may be used to adjust the pump speed and consequent flow rate of paint delivered to the brush. An OFF switch (not shown) is preferably actuated at the end of travel of the rotation of knob 32. Brush 24 has a handle 34, and an brush head 40 including a steel ferrule 36 and a plurality of filaments 38. Filaments or bristles 38 (the term "bristle" is most properly applied to natural porcine fibers) are preferably formed of synthetic materials. More particularly, the filaments are preferably made from a polyester and nylon blend with 6/12 nylon available from Dupont and are preferably a mixture of three sizes of tapered filaments with base sizes of 0.009, 0.012, and 0.015 inches, having respective tip diameters of 0.005, 0.008, and 0.010 inches.

Figure 4:
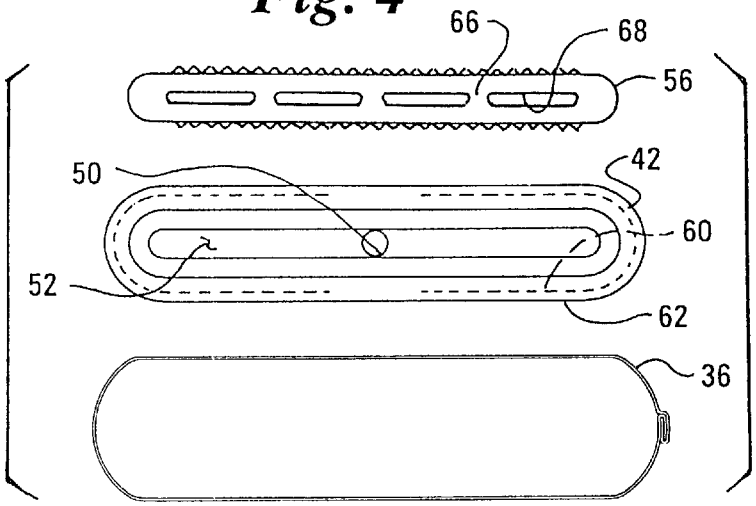
FIG. 4 is a top view of a ferrule, adaptor and extension useful in the brush head assembly of FIG. 2.
Figure 3:
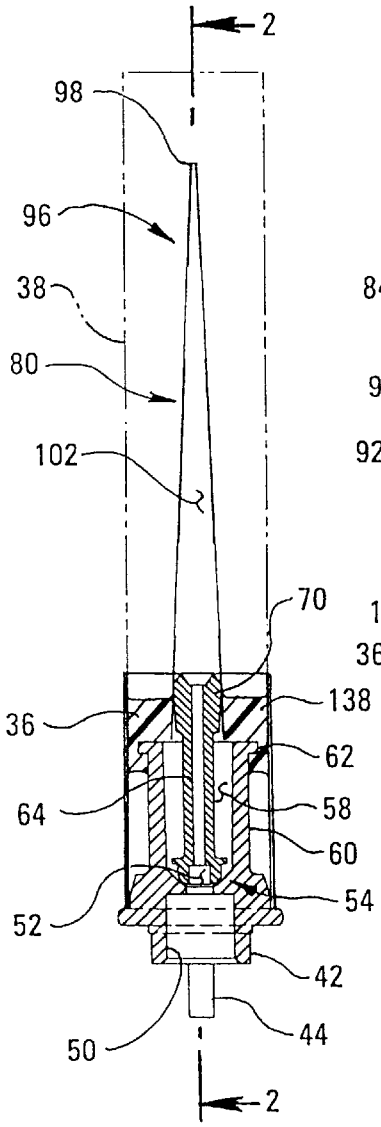
FIG. 3 is a side view in section taken along line 3—3 of the brush head assembly of FIG. 2.
Figure 2:
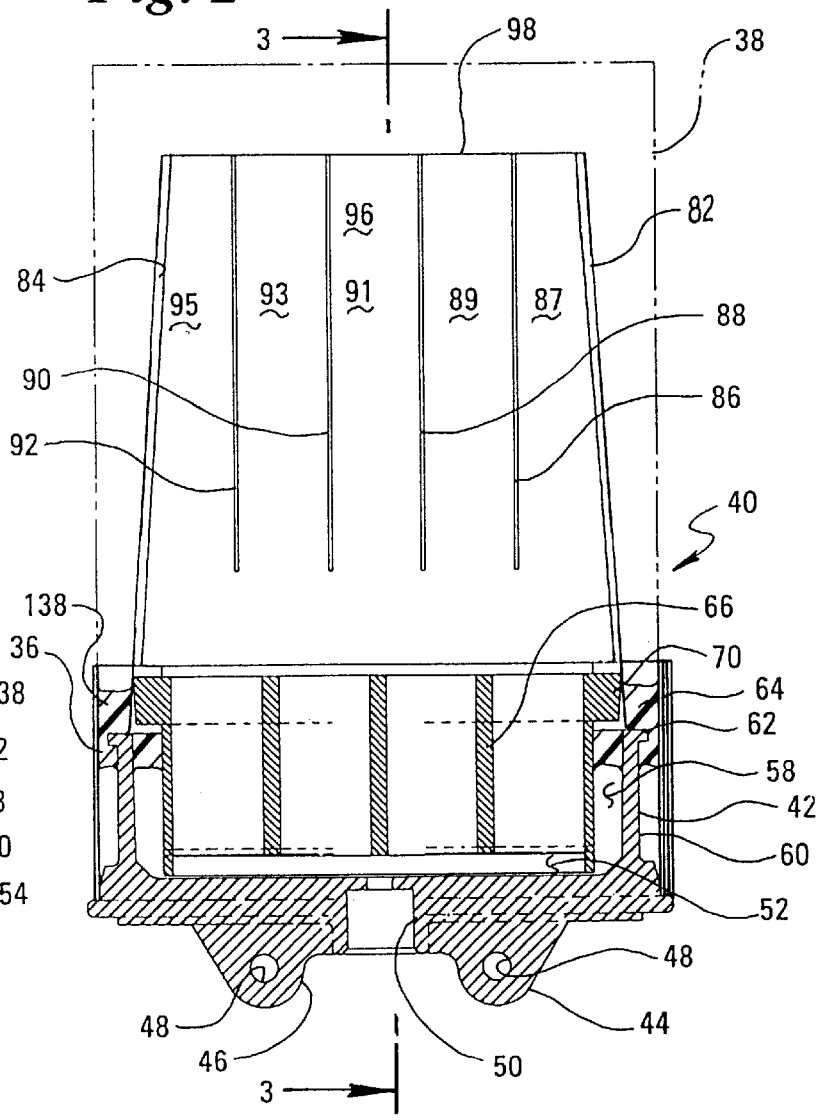
FIG. 2 is a side view in section along line 2—2 of FIG. 3 of a brush head assembly useful in the practice of the present invention.
Figure 15:
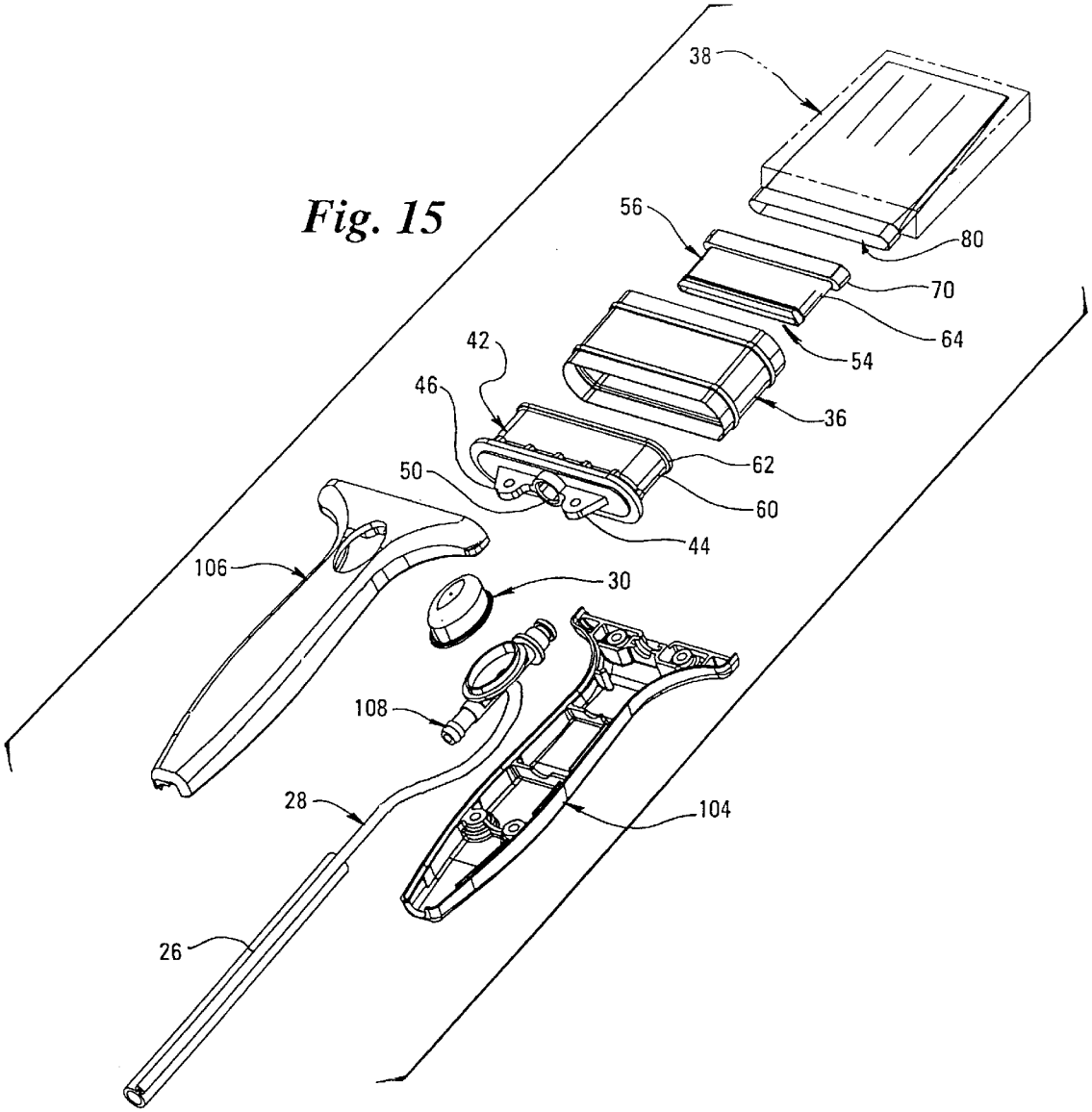
FIG. 15 is an exploded view of the paintbrush assembly useful in the practice of the present invention, together with fragments of tubing to supply paint and to transmit pneumatic ON-OFF commands from the brush handle air button to a remote paint pump.

Referring now also to FIGS. 2, 3, 4, various details of the internal structure of an brush head of brush 24 may be seen. It is to be understood that in FIGS. 3, 4 and 15 the filaments 38 are shown only in outline to better illustrate the present invention. Brush head 40 has an adaptor 42 having a pair of ears 44, 46, each with an aperture 48 to mount head 40 to handle 34. Adaptor 42 also has a paint inlet passageway 50 in fluid connection with a first plenum 52 formed at an inlet region 54 of an extension 56 in cooperation with adaptor 42. It is to be understood that extension 56 is sealed to adaptor 42 to form plenum 52 and prevent paint from entering the region 58 between extension 56 and adaptor 42. Adaptor 42 has a generally oval wall 60 surrounding region 58 and ending in a flange 62.

Figure 17:
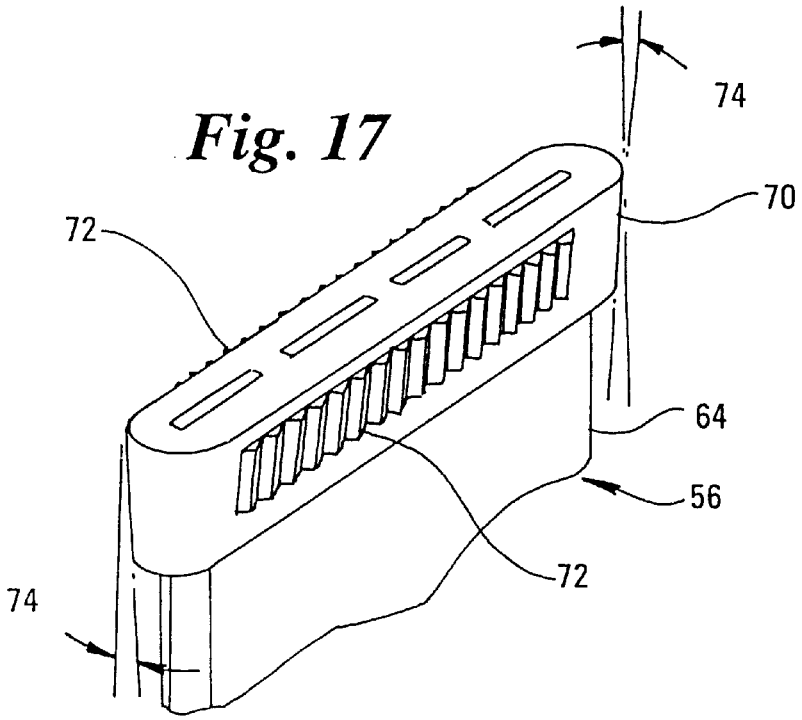
FIG. 17 is a detail view of a portion of the extension showing certain details thereof.

Extension 56 has a generally oval wall 64 and internal ribs 66 defining passages 68 through the extension 56. Extension 56 further has a relatively wide collar 70 at the outlet end thereof. Referring now also to FIG. 17, the collar 70 of extension 56 preferably has corrugations 72 along the principal sides of the collar 70. It addition, collar 70 is preferably tapered at an angle 74 of three degrees. Collar 70 may also have a pair of triangular cross-section ribs not shown on the outlet end thereof.

Figure 5:
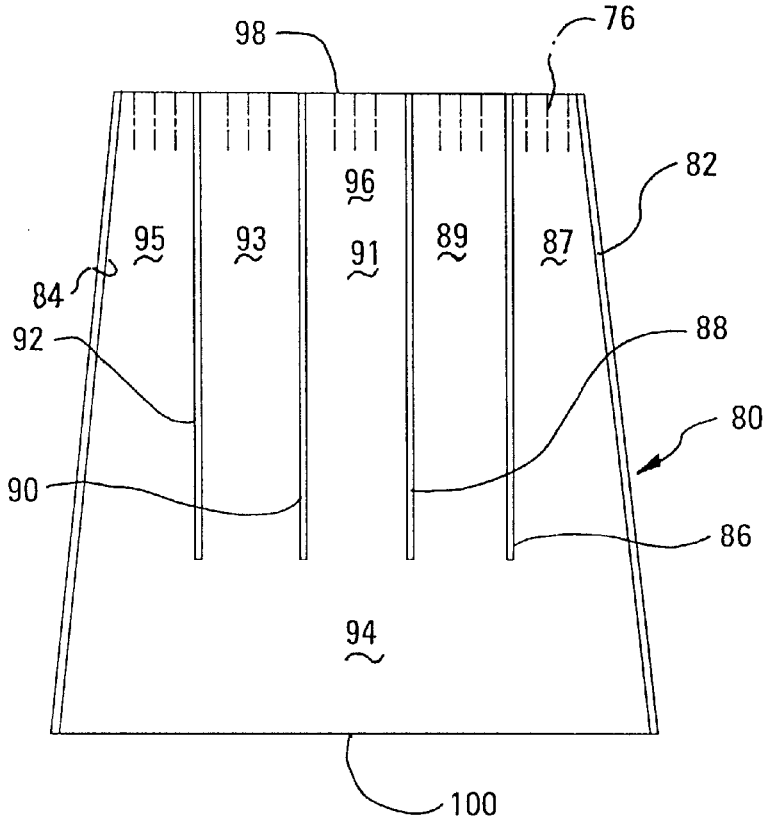
FIG. 5 is a side plan view of a paint distributor useful in the practice of the present invention.
Figure 6:
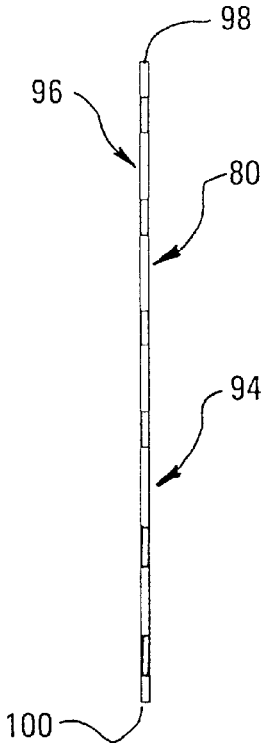
FIG. 6 is an edge view of the paint distributor of FIG. 5.
Figure 7:
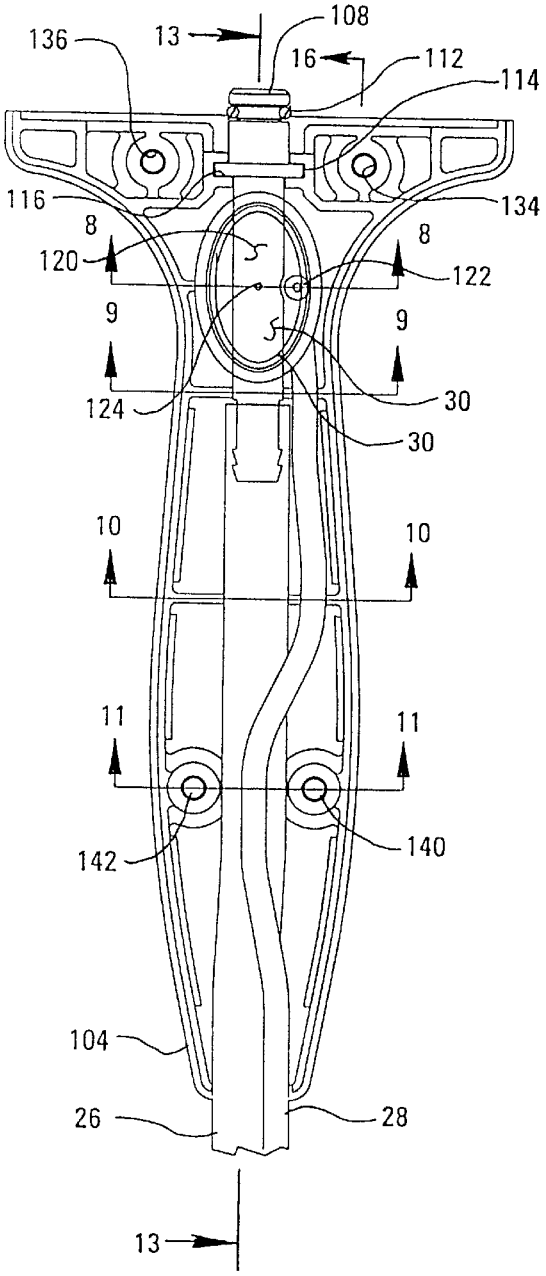
FIG. 7 is a side plan view of a handle assembly useful in the practice of the present invention with a handle top removed.
Figure 8:
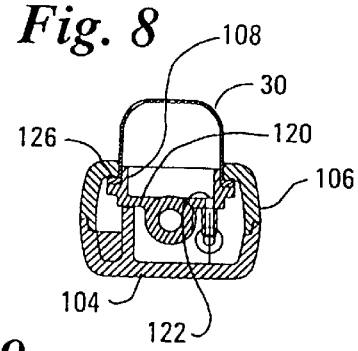
FIG. 8 is a section along line 8—8 of FIG. 7, except with the handle top in place.
Figure 9:
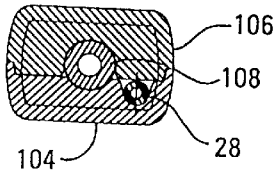
FIG. 9 is a section along line 9—9 of FIG. 7, except with the handle top in place.
Figure 10:
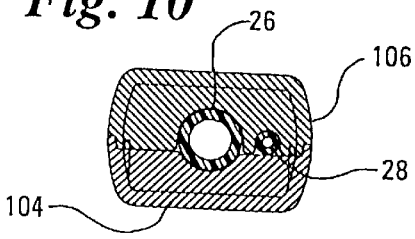
FIG. 10 is a section along line 10—10 of FIG. 7, except with the handle top in place.

Referring now most particularly to FIGS. 5 and 6, a highly flexible distributor or conduit or manifold 80 is formed of two layers of woven rip-stop nylon material having a polyurethane coating resulting in a liquid-impermeable structure because of the elastomer coating of polyurethane. Conduit 80 is formed by placing the polyurethane coated surfaces together and sonically welding lateral seams 82, 84 to form a near planar, open-ended passageway. Additionally seams or bonds 86, 88, 90, and 92 are sonically formed to provide generally parallel channels 87, 89, 91, 93, and 95 within conduit 80 from an intermediate region 94 to an outlet region 96 adjacent outlet edge 98. It is to be understood that inlet edge 100 is open to the interior 102 of conduit 80, as may be most clearly seen in FIG. 3. When paint flows through conduit 80, each of the channels in the outlet region 96 will be generally pillow-shaped. Even when delivering paint to the outlet region of the filaments 38, distributor 80 will remain extremely flexible (particularly contrasting to prior art rubber or plastic structures used to deliver paint to the interior of a plurality of bristles or filaments in internally fed paintbrushes) and thus the distributor of the present invention does not distort the flexure action of filaments 38 as the brush 24 is used in a conventional manner to apply paint to a surface to be painted. This is true whether the brush has a right angled face at the free end of the filaments (as does a conventional paint brush) or a mitered face (as does a "sash" type paint brush."

Referring now most particularly to FIGS. 7–16, certain details of the handle 34 may be seen. A handle bottom 104 and handle top 106 are sized to couple together to each other to make up a body for handle 34. A connector 108 provides a through lumen 110 (see FIG. 13) from paint supply tube 26 to paint inlet passageway 50 at the inlet to the brush paint head 40 (see FIGS. 2 and 3) and is sealed thereagainst by an O-ring 112. A flange 114 is provided on connector 108 which cooperates with hemi-cylindrical grooves 116, 118 in the handle bottom and top, respectively to locate and axially retain connector 108 in the handle body when the handle top 106 is secured to the handle bottom 104. Connector 108 also provides a base 120 for air button 30 and has a through aperture 122 connecting the interior of base 120 to air line or tube 28. Air button 30 has an aperture 124 therein to permit venting to atmosphere. It is to be understood that aperture 124 is covered and sufficiently sealed to permit pressurization of air tube 28 when air button 30 is depressed, while aperture 124 prevents barometric air pressure increases from pressurizing air tube 28. Air button 30 preferably has a flange 126 captured between handle top 106 and base 120 of connector 108 to seal air button against base 120.

Figure 11:
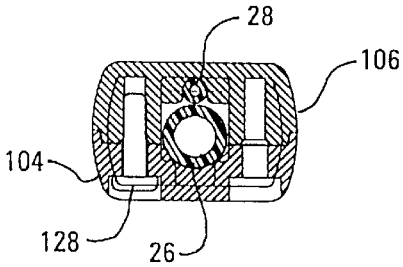
FIG. 11 is a section along line 11—11 of FIG. 7, except with the handle top in place.
Figure 13:
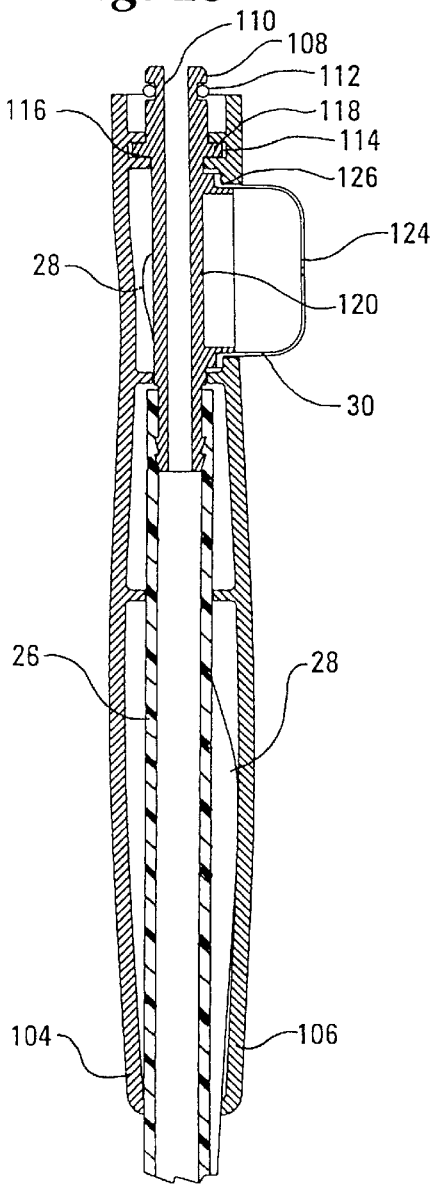
FIG. 13 is a side section view taken along line 13—13 of FIG. 7 of the handle assembly, except with the handle top in place.
Figure 12:
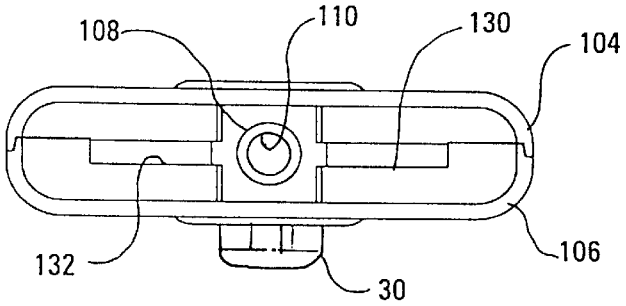
FIG. 12 is a top end view of the handle assembly of FIG. 7, except with the handle top in place.
Figure 16:
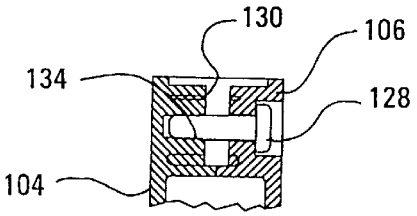
FIG. 16 is a fragmentary detail view of the adaptor secured in the handle with a retaining screw.
Figure 14:
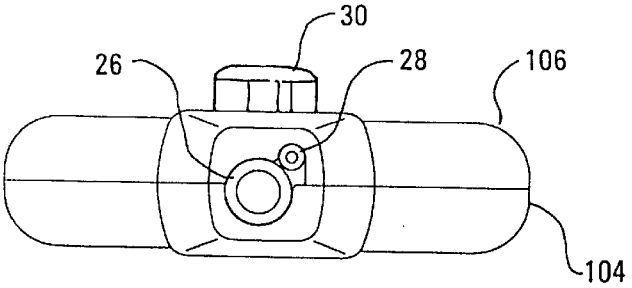
FIG. 14 is a bottom view of the handle assembly of FIG. 7 with the handle top in place.

Referring now to FIGS. 11 and 16, the handle top 106 is secured to handle bottom 104 by a plurality of screws 128. It is further to be understood that ears 44, 46 are received in slots 130, 132, respectively, and adaptor 42 is held against separation from the handle body by screws 128 received in apertures 134, 136.

The filaments 38 are preferably formed of a nylon/polyester combination, available from The Paint Brush Corporation, of 27 West Cherry Street, Vermillion, S. Dak. 57069, as Part No. Dupont Tynex 6–12. The distributor 80 is preferably formed of 40 Denier (0.006" thick) nylon laminated with a 0.003" thick coating of pin-hole-free polyurethane film on one side. The seams on distributor 80 are preferably 0.030" wide. The extension 56 is preferably 6,6 nylon, and thus forms a relatively rigid extension member. and the adaptor 42 is preferably formed of acetal plastic such as that available from DuPont under the trademark Delrin. The ferrule 36 is preferably nickel-plated steel. The tubes 26 and 28 are preferably PVC (polyvinylchloride) plastic, and the connector is preferably nylon. The handle top and bottom 106, 104 are each preferably formed of nylon or polyester.

Figure 18:
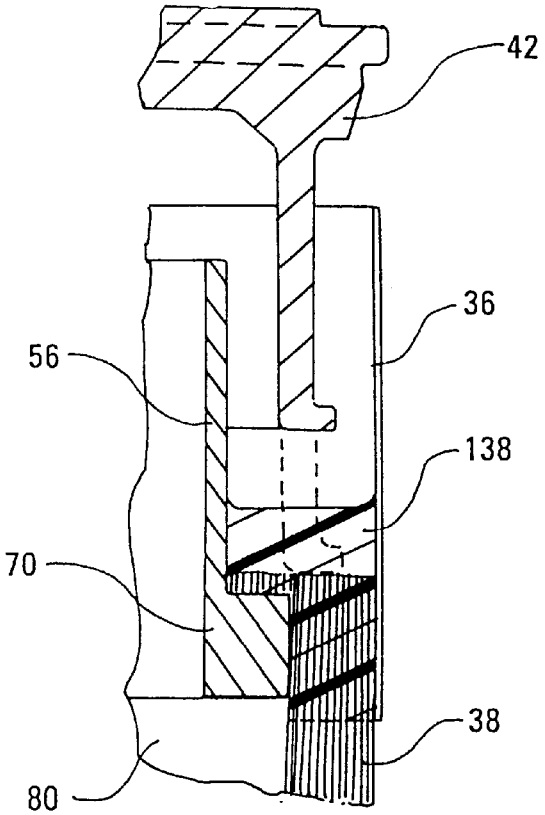
FIG. 18 is a detail view of a portion of the brush head in an inverted, partially assembled condition, showing the epoxy securing the plurality of filaments therein.

To assemble the brush 24, the distributor 80 is sonically welded i.e., sonically bonded to corrugations 72 on extension 56. The filaments 38 are placed in ferrule 36 with the free ends facing downward and the filament bundle is shaped to receive extension 56 with distributor 80 attached thereto. The angle or taper 74 aids in retention of the filaments as the extension 56 is inserted into the filaments. An epoxy fill 138 is then applied to the ferrule end of the filaments to surround extension 56 thereby securing filaments 38, ferrule 36, distributor 80 and extension 56 together at the base end of the filaments. The subassembly including extension 56 is then secured to adaptor 42 using a bead of epoxy around the inlet edge of extension 56 and adaptor 42 is inserted into ferrule 36 engaging the epoxy 138, securing or locking adaptor 42 via the epoxy fill 138, as indicated in FIG. 18 by the dashed line position for adaptor 42. It is to be understood that the epoxy 138 preferably extends within ferrule 36 a distance sufficient to engage and preferably surround flange 62 of adaptor 42. The completed brush head assembly may be seen in FIGS. 2 and 3.

The handle body is assembled by engaging tubes 26 and 28 with the respective mating surfaces of connector 108, and placing the tubes and connector into handle bottom 104. The air button is then placed over base 120 and the handle top 106 is placed over handle bottom 104 with the parts therein. Screws 128 are then inserted in the apertures 140, 142, and the brush head 40 is engaged with the handle body and screws 128 are then inserted into apertures 134, 136 to retain the brush head to the handle body. A distal end of tube 26 is connected to a source of paint, and a distal end of tube 28 is connected to an air switch to actuate a paint pump to supply paint upon demand through tube 26. The paint is preferably delivered to a region approximately one-half inch from the free end of the filaments 38, and the flexibility of the distributor 80, together with the channels 87–95 therein deliver paint evenly and without interference to the filaments 38 for application thereby. It is to be understood that, as used herein, the term "highly flexible" refers to a property of the distributor wherein the distributor 80 is more limber than the plurality of filaments 38. In the embodiment shown and described, the distributor 80 is flexible enough to be non self supporting in that the distributor 80 will not remain horizontal when cantilever-supported (by itself) at the inlet end thereof; i.e., the outlet end will "droop" in such circumstances. Such a degree of flexibility in the distributor of the present invention avoids influencing the paint brush filament action when the brush is used to apply and level paint.

In another embodiment, the outlet end or edge 98 may have slits therein (as indicated in FIG. 5 by phantom lines 76) to form fringe on the outlet edge of distributor 80.

The invention is not to be taken as limited to all of the details thereof as modifications and variations thereof may be made without departing from the spirit or scope of the invention. For example (but not by way of limitation), the materials may be changed as desired, to other suitable materials (such as using other materials for the filaments, including natural bristles) while still remaining within the spirit and scope of the claimed invention.

What is claimed is:

1. An improved internally fed paint brush of the type having paint delivered to a region internal of a plurality of filaments, the improved brush comprising:

a) a handle assembly; and b) a brush head assembly, the handle assembly having i) a proximal portion adapted to be grasped by an operator, ii) a distal portion having a rigid brush head mounting means for securing the brush head assembly to the handle assembly, and iii) an internal paint supply passageway for delivering paint to the brush head assembly; and the brush head assembly having i) a plurality of filaments having a free end directed away from the distal end of the brush head assembly, and ii) a relatively flat, highly flexible paint distributor interior of the plurality of filaments and fluidly coupled to the internal paint supply passageway of the handle assembly, formed of a woven nylon material coated with polyurethane to be liquid impermeable and open at an inlet end and an outlet end thereof wherein the material is sufficiently limber to be non-self supporting and thus avoid affecting the leveling action of the filaments as paint is applied to a surface with the brush.

2. The brush of claim 1 wherein the paint distributor further comprises a near planar conduit having an open plenum at an inlet region thereof and a plurality of spaced-apart bonds at an outlet region thereof to direct paint into a plurality of channels formed by the spaced-apart bonds.

3. The improved brush of claim 2 wherein the distributor is formed of two layers of material and the bonds are formed by heat sealing the two layers of material together.

4. The improved brush of claim 3 wherein the distributor is fringed at an outlet end thereof by slitting the two layers of material forming the distributor.

5. The improved brush of claim 1 wherein the brush head assembly further includes a rigid extension member and the distributor is sonically bonded to the extension member.

6. The improved brush of claim 5 wherein the distributor and extension member are sealed together with epoxy.

7. The improved brush of claim 5 wherein the filaments are secured in the brush head assembly with epoxy.

8. A method of supplying paint to an internally fed paint brush comprising the steps of:

a) delivering paint to a hand-held paint brush via a flexible tube;

b) moving the paint into a near-planar, highly flexible manifold formed of a nylon material coated with polyurethane to be liquid impermeable and open at an inlet end and an outlet end thereof, wherein the manifold is interior of a plurality of filaments in the paint brush; and c) delivering the paint from the manifold to a region near a free end of the plurality of filaments wherein the filaments are rigidly secured to a handle of the brush;

such that paint is loaded into the free end of the filaments and wherein the manifold is sufficiently limber to be non-self-supporting and conform to flexure of the filaments during painting and thus avoid affecting the leveling action of the filaments as paint is applied to a surface with the brush.

9. The method of claim 8 wherein the paint is delivered upon demand to the brush from a remote paint reservoir.

10. The method of claim 8 wherein the manifold is connected at an inlet end thereof to a rigid member at least partially forming an inlet plenum for the paint as it enters the flexible manifold.

11. The method of claim 10 wherein the rigid member and inlet end of the flexible manifold are sealed with epoxy to direct paint from the tube through the flexible manifold to the region near the free end of the plurality of filaments.

12. The method of claim 11 wherein the paint is moved through a plurality of channels in the flexible manifold aligned with the filaments.

13. The method of claim 12 wherein the manifold is slit to form fringe at an outlet thereof.

* * * * *